US010693228B2

(12) United States Patent
Wang

(10) Patent No.: US 10,693,228 B2
(45) Date of Patent: Jun. 23, 2020

(54) ANTENNA KIT

(71) Applicant: TRANS ELECTRIC CO., LTD., Huatang, Changhua (TW)

(72) Inventor: Ching-Yuan Wang, Changhua (TW)

(73) Assignee: TRANS ELECTRIC CO., LTD., Huatang (TW)

( * ) Notice: Subject to any disclaimer, the term of this patent is extended or adjusted under 35 U.S.C. 154(b) by 17 days.

(21) Appl. No.: 16/253,448

(22) Filed: Jan. 22, 2019

(65) Prior Publication Data

US 2020/0136249 A1 Apr. 30, 2020

(30) Foreign Application Priority Data

Oct. 29, 2018 (TW) ..... 107214660 A

(51) Int. Cl.
*H01Q 3/26* (2006.01)
*H01Q 11/14* (2006.01)
*H01Q 1/24* (2006.01)

(52) U.S. Cl.
CPC ..... *H01Q 3/2629* (2013.01); *H01Q 1/24* (2013.01); *H01Q 11/14* (2013.01)

(58) Field of Classification Search
CPC ..... H01Q 3/2629; H01Q 11/14; H01Q 1/24; H01L 31/0232; H01L 31/0352; H01L 31/0248
See application file for complete search history.

(56) References Cited

U.S. PATENT DOCUMENTS 5,914,497 A * 6/1999 Sherwin ..... B82Y 20/00 257/194
9,570,797 B2 * 2/2017 Wang ..... H01Q 1/007
10,164,341 B2 * 12/2018 Tsai ..... H01Q 9/265
2003/0043084 A1 * 3/2003 Egashira ..... H01Q 13/106 343/767

* cited by examiner

*Primary Examiner* — Daniel D Chang
(74) *Attorney, Agent, or Firm* — Burris Law, PLLC

(57) ABSTRACT

An antenna kit includes: main and auxiliary antenna units to be disposed respectively on first and second dielectric substrates; and two connecting units. The main antenna unit includes two main radiating modules which are symmetrical with respect to a first axis, and each of which includes a main feed point, a main radiating portion and an extending portion. The auxiliary antenna unit is symmetrical with respect to a second axis, and includes two auxiliary feed points, two auxiliary radiating portions and a connecting portion. Each connecting unit is capable of being assembled such that the main radiating portion of a respective main radiating module and a respective auxiliary radiating portion are connected via the assembled connecting unit.

10 Claims, 12 Drawing Sheets

ANTENNA KIT

CROSS-REFERENCE TO RELATED APPLICATION

This application claims priority of Taiwanese Patent Application No. 107214660, filed on Oct. 29, 2018.

FIELD

The disclosure relates to an antenna kit, and more particularly to an antenna kit for digital television broadcasting.

BACKGROUND

Digitalization of television (TV) broadcasting has been actively promoted in recent years by many countries to reduce waste of channel resources and to improve transmission quality of audiovisual content. An antenna device, a pivotal component for receiving digital TV signals transmitted by wireless TV stations between an audiovisual device and a propagation medium, has to not only convert between electrical and electromagnetic domains, but to also reduce electromagnetic attenuation in a specific frequency band to improve a signal-to-noise ratio (SNR) of the signal received thereby. For current digital TV broadcasting, the frequency band usually ranges from 470 MHz to 700 MHz.

Referring to FIG. 1, a conventional antenna device includes two radiating portions 11 that are symmetrical with respect to an axis (not shown) and that each have an isosceles triangular shape, and a feed portion 12 that is arranged on the axis. Gain performance of the conventional antenna device in the abovementioned frequency band is represented in FIG. 4 by a curve 81, and has room for improvement.

SUMMARY

Therefore, an object of the disclosure is to provide an antenna kit that is flexible in use and that has improved gain performance in a frequency band of digital TV broadcasting.

According to the disclosure, the antenna kit includes a main antenna unit, an auxiliary antenna unit and two connecting units. The main antenna unit is to be disposed on a first dielectric substrate, and includes two main radiating modules substantially symmetrical with respect to a first axis. Each of the main radiating modules includes a main feed point that is adjacent to the first axis, a main radiating portion that extends and expands from the main feed point and away from the first axis, and an extending portion that extends toward the first axis from a first vertex part of the main radiating portion distal from the first axis and that does not reach the first axis. The auxiliary antenna unit is to be disposed on a second dielectric substrate, and is substantially symmetrical with respect to a second axis. The auxiliary antenna unit includes two auxiliary feed points respectively disposed at two sides of the second axis and adjacent to the second axis, two auxiliary radiating portions each extending and expanding from a respective one of the auxiliary feed points and away from the second axis, and a connecting portion connected to respective first vertex parts of the auxiliary radiating portions distal from the second axis. Each of the connecting units is connected to a second vertex part of the main radiating portion of a respective one of the main radiating modules that is distal from the main feed point and the extending portion of the respective one of the main radiating modules. Each of the connecting units is connected further to a second vertex part of a respective one of the auxiliary radiating portions that is distal from the auxiliary feed points and the connecting portion. Each of the connecting units is capable of being assembled such that the main radiating portion of the respective one of the main radiating modules and the respective one of the auxiliary radiating portions are connected to each other via the assembled connecting unit.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
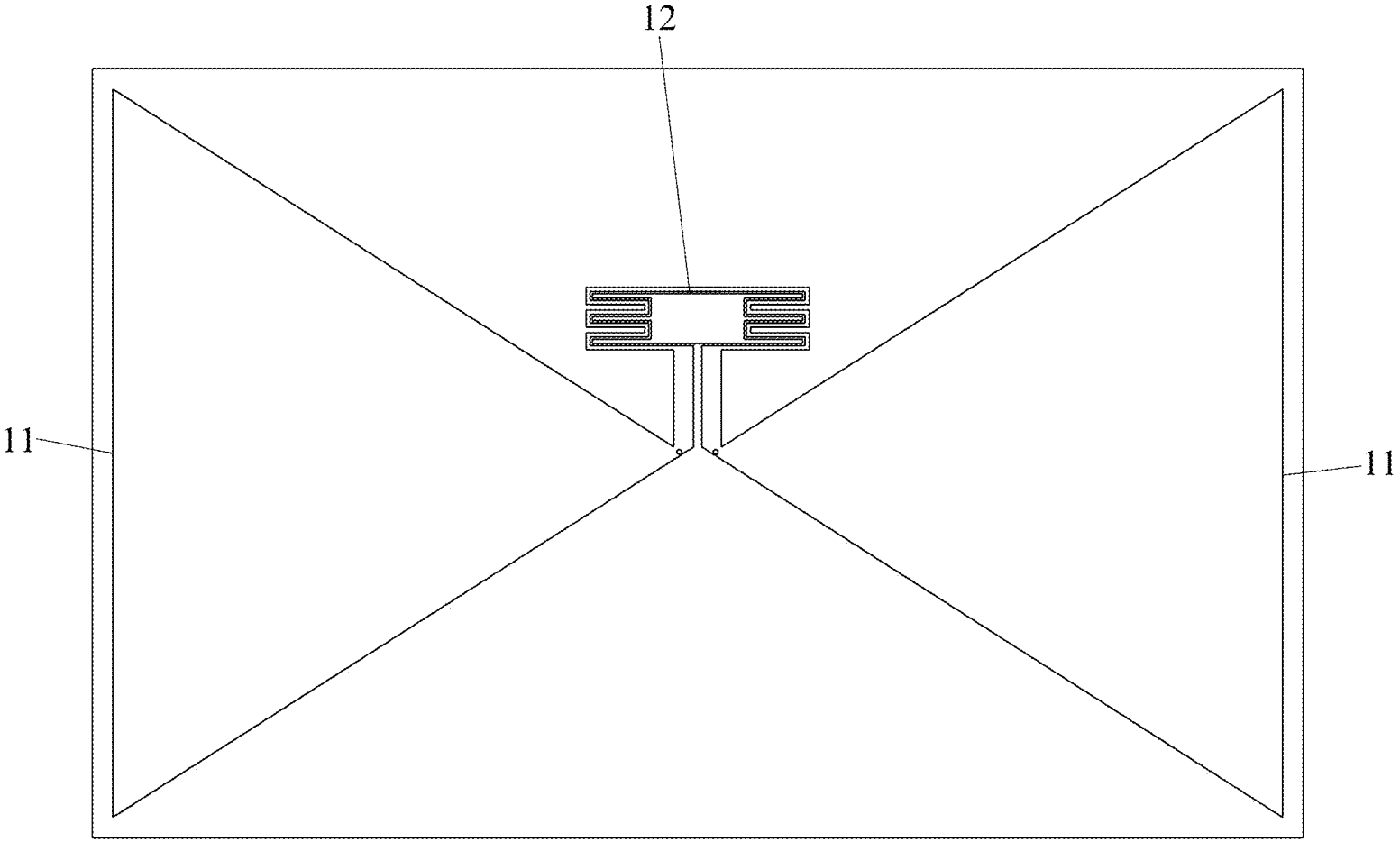
FIG.1 PRIOR ART
FIG. 1 is a plan view of a conventional antenna device.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
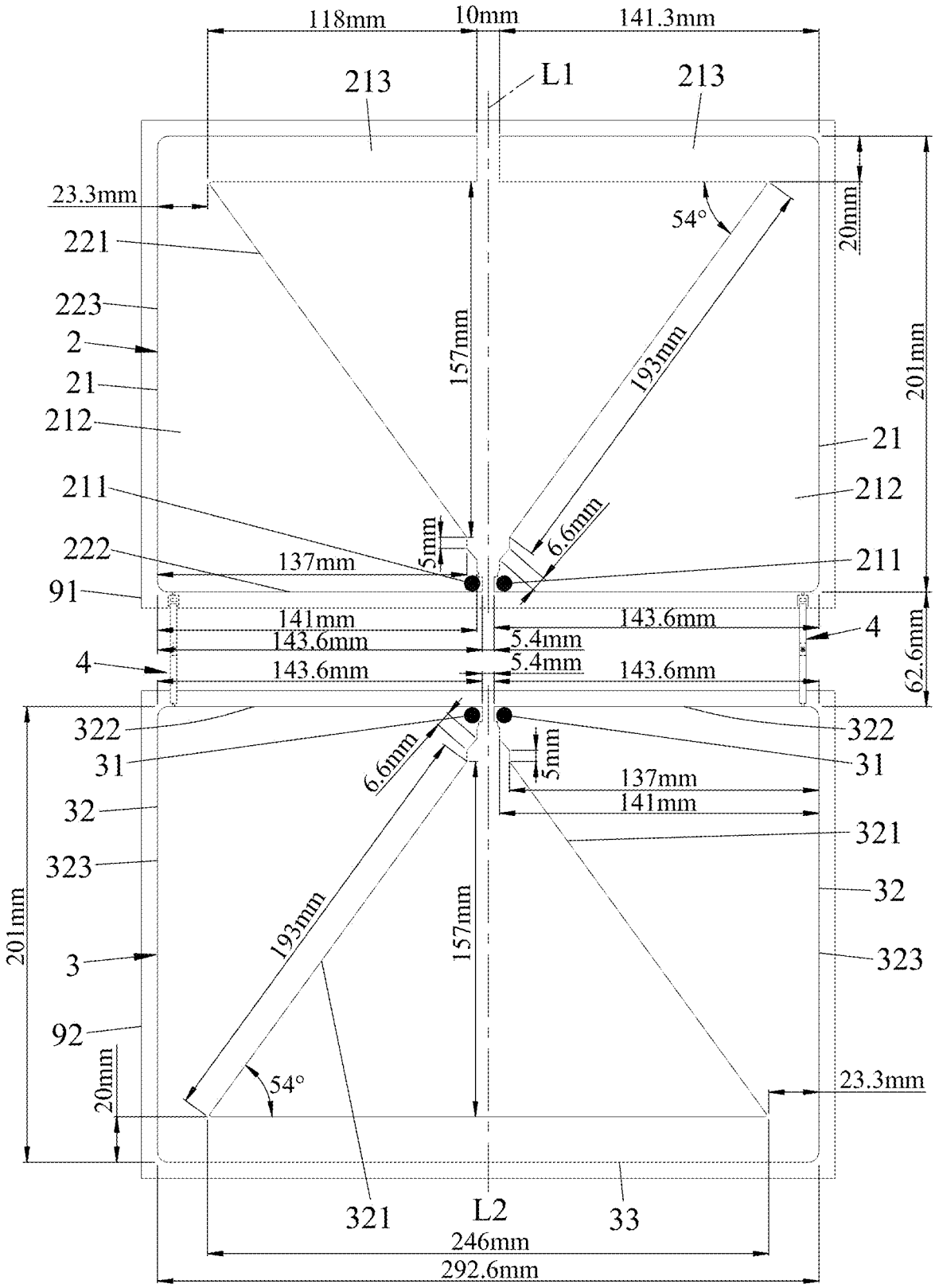
FIG. 2 is a plan view of a first embodiment of an antenna kit according to the disclosure.
Figure 3:
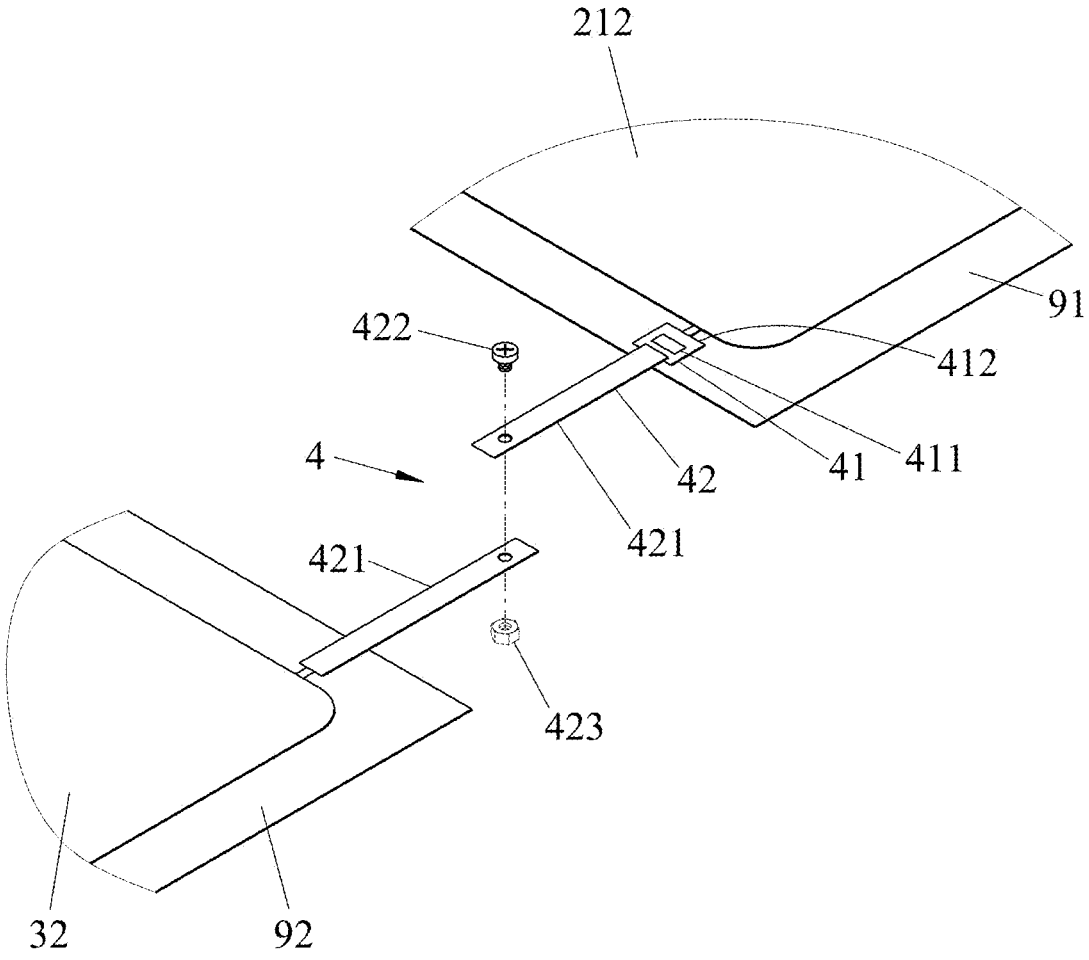
FIG. 3 is a partial perspective view of the first embodiment.
Figure 4:
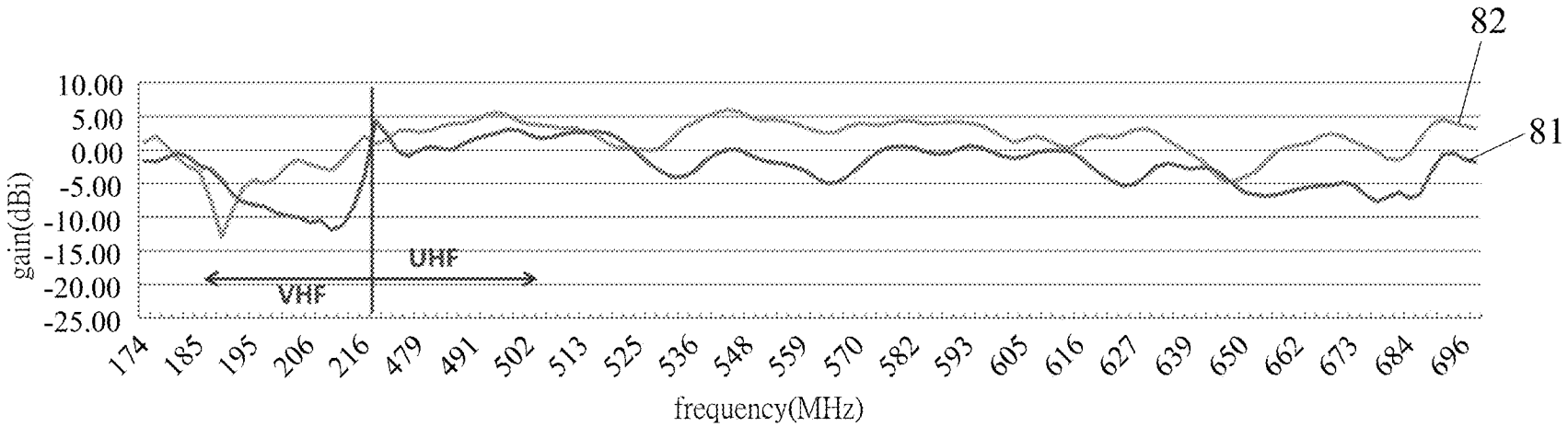
FIGS. 4 to 7 are plots illustrating gain versus frequency characteristic for the conventional antenna device, the first embodiment and a modification of the first embodiment.
Figure 5:
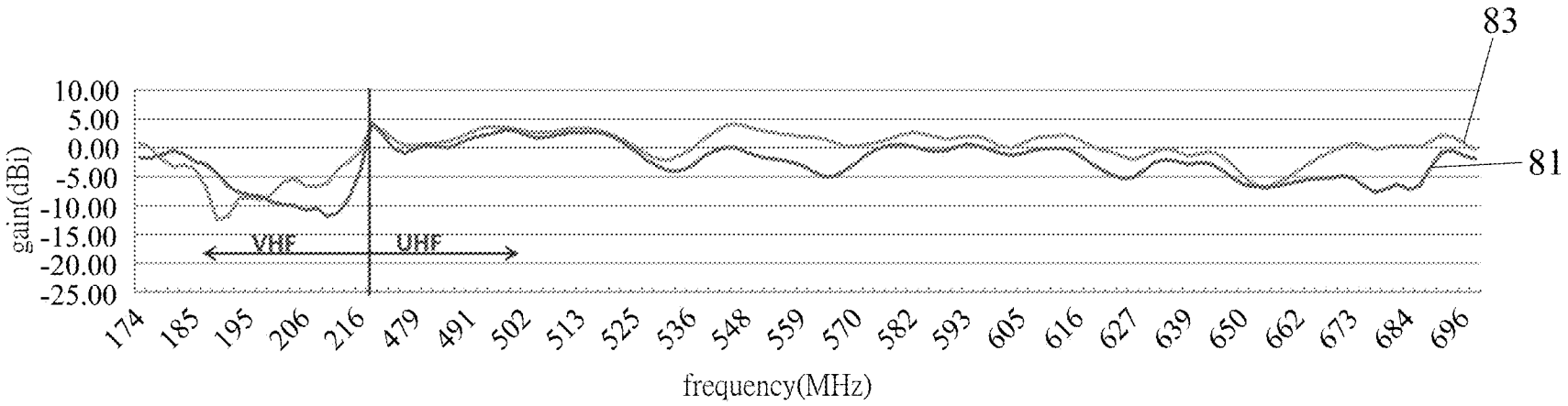
Figure 6:
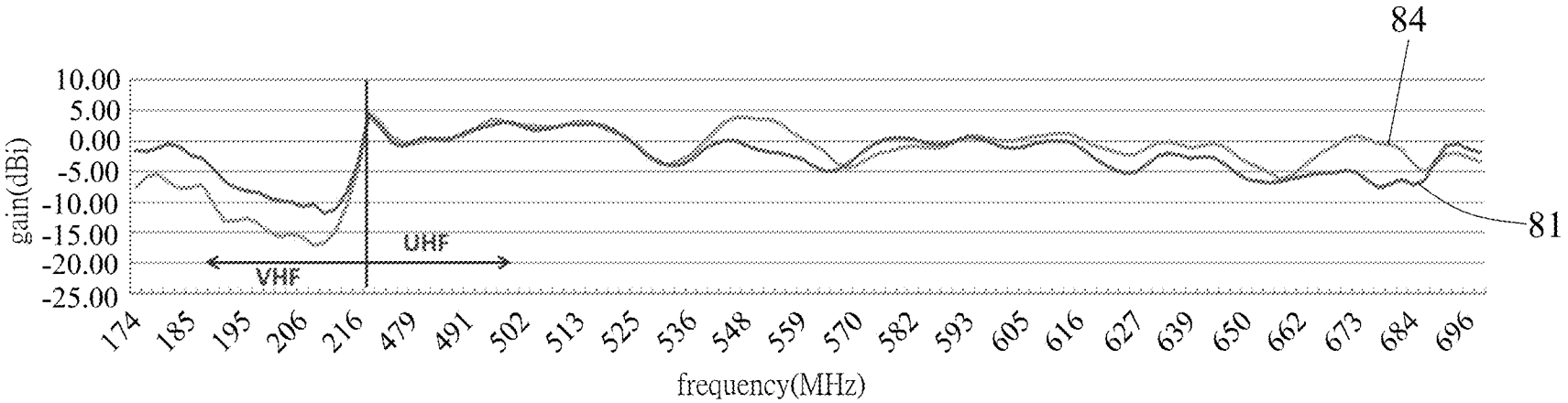
Figure 7:
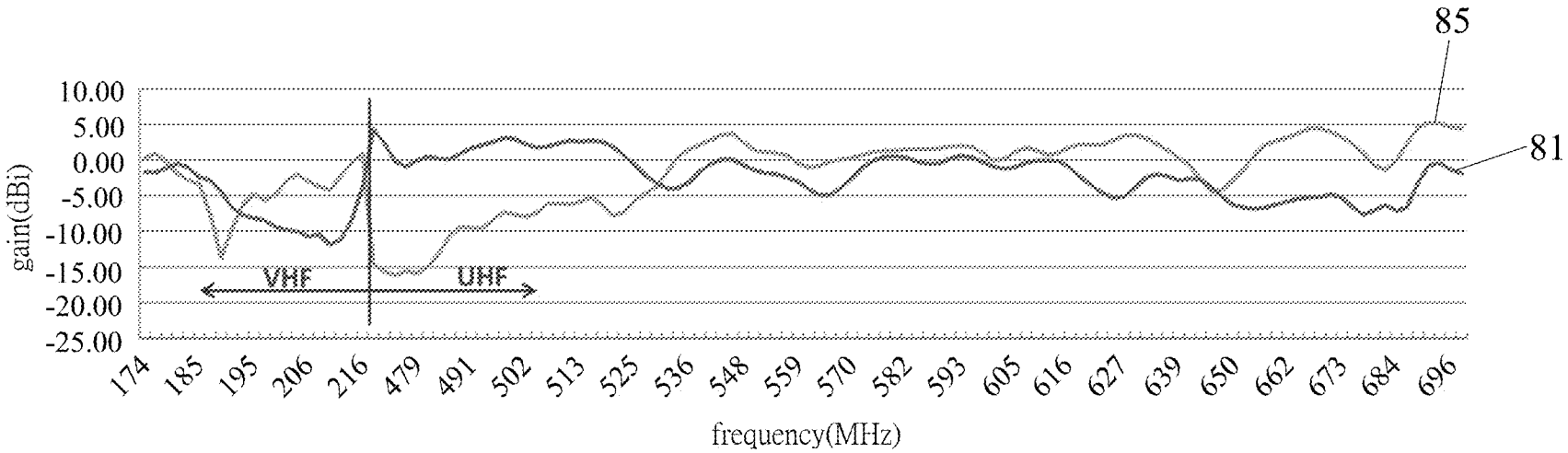

Referring to FIGS. 2 and 3, a first embodiment of an antenna kit according to the disclosure includes a main antenna unit 2, an auxiliary antenna unit 3 and two connecting units 4.

The main antenna unit 2 is to be disposed on a first dielectric substrate 91, and includes two main radiating modules 21 substantially symmetrical with respect to a first axis (L1).

Each of the main radiating modules 21 includes a main feed point 211, a main radiating portion 212 and an extending portion 213. The main feed point 211 is adjacent to the first axis (L1). The main radiating portion 212 extends and expands from the main feed point 21 and away from the first axis (L1). The extending portion 213 extends toward the first axis (L1) from a first vertex part of the main radiating portion 212 distal from the first axis (L1), but does not reach the first axis (L1). In this embodiment, for each of the main radiating modules 21, the main radiating portion 212 has a first edge 221, a second edge 222 and a third edge 223. The first edge 221 extends from a location adjacent to the main feed point 211, away from the first axis (L1), and along a direction diagonal to the first axis (L1). An end part of the first edge 221 adjacent to the main feed point 211 is stair-shaped. The second edge 222 extends from the location adjacent to the main feed point 211, away from the first axis (L1), and along a direction perpendicular to the first axis (L1). The third edge 223 extends from an end point of the first edge 221 distal from the first axis (L1), to an end point of the second edge 222 distal from the first axis (L1), and along a direction parallel to the first axis (L1).

In this embodiment, for each of the main radiating modules 21, the extending portion 213 extends along a direction perpendicular to the first axis (L1) from an end part of the first edge 221 of the main radiating portion 212 adjacent to the third edge 223 of the main radiating portion 212.

The auxiliary antenna unit 3 is to be disposed on a second dielectric substrate 92, and is substantially symmetrical with respect to a second axis (L2). The auxiliary antenna unit 3 includes two auxiliary feed points 31, two auxiliary radiating portions 32 and a connecting portion 33. The auxiliary feed points 31 are respectively disposed at two sides of the second axis (L2), and are adjacent to the second axis (L2). Each of the auxiliary radiating portions 32 extends and expands from a respective one of the auxiliary feed points 31 and away from the second axis (L2). The connecting portion 33 has two opposite ends that are respectively connected to first vertex parts of the auxiliary radiating portions 32 distal from the second axis (L2).

In this embodiment, each of the auxiliary radiating portions 32 has a first edge 321, a second edge 322 and a third edge 323. The first edge 321 of each of the auxiliary radiating portions 32 extends from a location adjacent to the respective one of the auxiliary feed points 31, away from the second axis (L2) and along a direction diagonal to the second axis (L2). An end part of the first edge 321 adjacent to the corresponding one of the auxiliary feed points 31 is stair-shaped. The second edge 322 extends from the location adjacent to the corresponding one of the auxiliary feed points 31, away from the second axis (L2), and along a direction perpendicular to the second axis (L2). The third edge 323 extends from an end point of the first edge 321 distal from the second axis (L2), to an end point of the second edge 322 distal from the second axis (L2), and along a direction parallel to the second axis (L2).

In this embodiment, the connecting portion 33 extends along a direction perpendicular to the second axis (L2), and has two opposite ends respectively connected to end parts of the first edges 321 of the auxiliary radiating portions 32 that are distal from the second axis (L2) and that are adjacent to the respective third edges 323 of the auxiliary radiating portions 32.

In an example, each of the main and auxiliary antenna units 2, 3 is formed on the corresponding one of the first and second dielectric substrates 91, 92 using conductive silver paint, and is of a thin film type.

For each of the main radiating modules 21, a respective one of the connecting units 4 is connected to a second vertex part of the main radiating portion 212 that is distal from both the main feed point 211 and the extending portion 213. Each of the connecting units 4 is connected further to a second vertex part of a respective one of the auxiliary radiating portions 32 that is distal from both the auxiliary feed points 31 and the connecting portion 33. Each of the connecting units 4 is capable of being assembled such that the main radiating portion 212 of the respective one of the main radiating modules 21 and the respective one of the auxiliary radiating portions 32 are connected to each other via the assembled connecting unit 4.

In this embodiment, each of the connecting units 4 includes an inductive element 41 and a conductive element 42. The inductive element 41 includes a printed circuit board (PCB) 412 to be disposed on the first dielectric substrate 91, and an inductor 411 disposed on the PCB 412. The inductor 411 has a first terminal connected to the second vertex part of the main radiating portion 212 of the corresponding one of the main radiating modules 21 via the PCB 412, and a second terminal. In an example, the inductor 411 has an inductance of 56 nH. The conductive element 42 includes two iron strips 421, a screw 422 and a nut 423. A first one of the iron strips 421 has a first end part that is to be disposed on the first dielectric substrate 91 and that is connected to the second terminal of the inductor 411 via the PCB 412, and a second end part that is formed with a through hole. A second one of the iron strips 421 has a first end part that is to be disposed on the second dielectric substrate 92 and that is connected to the second vertex part of the corresponding one of the auxiliary radiating portions 32, and a second end part that is formed with a through hole. The conductive element 42 is capable of being assembled bypassing the screw 422 through the through holes formed on the second end parts of the iron strips 421 and engaging the screw 422 and the nut 423. When the conductive element 42 is assembled, the iron strips 421 are securely connected to each other, and the main radiating portion 212 of the corresponding one of the main radiating modules 21 and the corresponding one of the auxiliary radiating portions 32 are connected to each other via the inductor 411 and the securely connected iron strips 421.

It should be noted that, for each of the connecting units 4, the inductive element 41 is included for impedance matching in this embodiment, but may be omitted in another embodiment.

It should also be noted that, in this embodiment, the inductive element 41 of each of the connecting units 4 is to be disposed on the first dielectric substrate 91 and is connected between the main radiating portion 212 of the respective one of the main radiating modules 21 and the first one of the iron strips 421, but may be disposed on the second dielectric substrate 92 and may be connected between the respective one of the auxiliary radiating portions 32 and the second one of the iron strips 421 in another embodiment.

It should also be noted that, for each of the connecting units 4, the inductive element 41 is obtained by placing and soldering the stand-alone inductor 411 onto the PCB 412 in this embodiment, but may be obtained by laying out a meander inductor and etching the same onto a PCB in another embodiment.

Example values for various dimensions of the antenna kit of this embodiment are given in FIG. 2. Although a distance between the main and auxiliary antenna units 2, 3 is shown to be 62.6 mm in FIG. 2, it is suitably in a range from 2 mm to 62.6 mm. Each of the other dimensions is suitably in a range from 60% to 140% of the corresponding example value shown in FIG. 2, and is more suitably in a range from 70% to 130% of the corresponding example value shown in FIG. 2.

By virtue of the connecting units 4 that can be selectively assembled and disassembled, the main and auxiliary antenna units 2, 3 can be used both individually and in combination. When both of the connecting units 4 are assembled, the main and auxiliary antenna units 2, 3 are used in combination, and the main feed points 211 serve as signal feed points of the combination of the main and auxiliary antenna units 2, 3. The combination of the main and auxiliary antenna units 2, 3 can provide a good pathway for electromagnetic waves, thereby attaining good gain performance. When both of the connecting units 4 are disassembled, the main and auxiliary antenna units 2, 3 are used individually, the main feed points 211 serve as signal feed points of the main antenna unit 2, and the auxiliary feed points 31 serve as signal feed points of the auxiliary antenna unit 3.

FIGS. 4 to 7 depict five curves 81-85 that respectively illustrate gain performances of the conventional antenna device (see FIG. 1), the combination of the main and auxiliary antenna units 2, 3 (see FIG. 2) of this embodiment, the main antenna unit 2, the auxiliary antenna unit 3 and a combination of main and auxiliary antenna units of a modified embodiment in a very high frequency (VHF) band from 174 MHz to 216 MHz and an ultra high frequency (UHF) band from 470 MHz to 698 MHz. In the modified embodiment, the inductive element 41 (see FIG. 3) of each of the connecting units 4 (see FIG. 2) is omitted.

Table 1 illustrates average gains of the conventional antenna device (see FIG. 1), the combination of the main and auxiliary antenna units 2, 3 (see FIG. 2) of this embodiment, the main antenna unit 2, the auxiliary antenna unit 3, and the combination of the main and auxiliary antenna units of the modified embodiment in the VHF band, the UHF band and a combination of the VHF and UHF bands.

TABLE 1

| | I | II | III | IV | V |
|---|---|---|---|---|---|
| average gain in VHF band | −6.31 dBi | −2.96 dBi | −5.40 dBi | −11.27 dBi | −3.69 dBi |
| average gain in UHF band | −1.76 dBi | 2.25 dBi | 0.72 dBi | −0.40 dBi | −1.43 dBi |
| average gain in combination of VHF and UHF bands | −8.08 dBi | −0.72 dBi | −4.68 dBi | −11.67 dBi | −5.12 dBi |

I: conventional antenna device
II: combination of main and auxiliary antenna units of this embodiment
III: main antenna unit
IV: auxiliary antenna unit
V: combination of main and auxiliary antenna units of modified embodiment It can be reasonably determined from FIGS. 4 to 7 and Table 1 that: (a) the average gains of the combination of the main and auxiliary antenna units 2, 3 (see FIG. 2) of this embodiment in the VHF band, the UHF band and the combination of the VHF and UHF bands are respectively better than those of the conventional antenna device; (b) the average gains of the main antenna unit 2 in the VHF band, the UHF band and the combination of the VHF and UHF bands are respectively better than those of the conventional antenna device; (c) the average gain of the auxiliary antenna unit 3 in the UHF band is better than that of the conventional antenna device; and (d) the average gains of the combination of the main and auxiliary antenna units of the modified embodiment in the VHF band, the UHF band and the combination of the VHF and UHF bands are respectively better than those of the conventional antenna device.

Referring back to FIG. 2, in view of the above, since the main and auxiliary antenna units 2, 3 can be used both individually and in combination, the antenna kit of this embodiment is flexible in use. In addition, the main and auxiliary antenna units 2, 3 have good gain performance in the UHF band used in digital television broadcasting, both individually and in combination.

Figure 8:
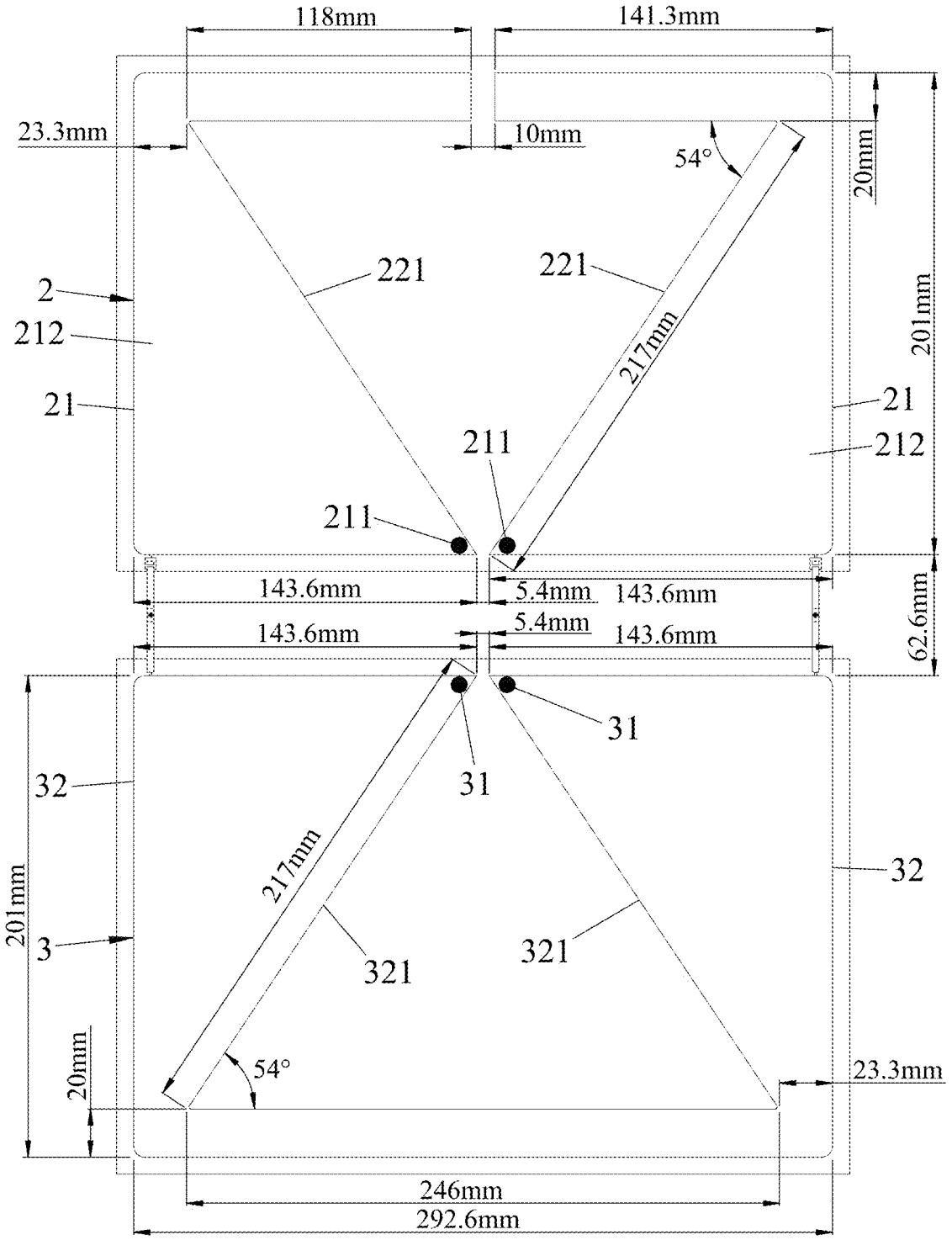
FIG. 8 is a plan view of a second embodiment of the antenna kit according to the disclosure.
Figure 9:
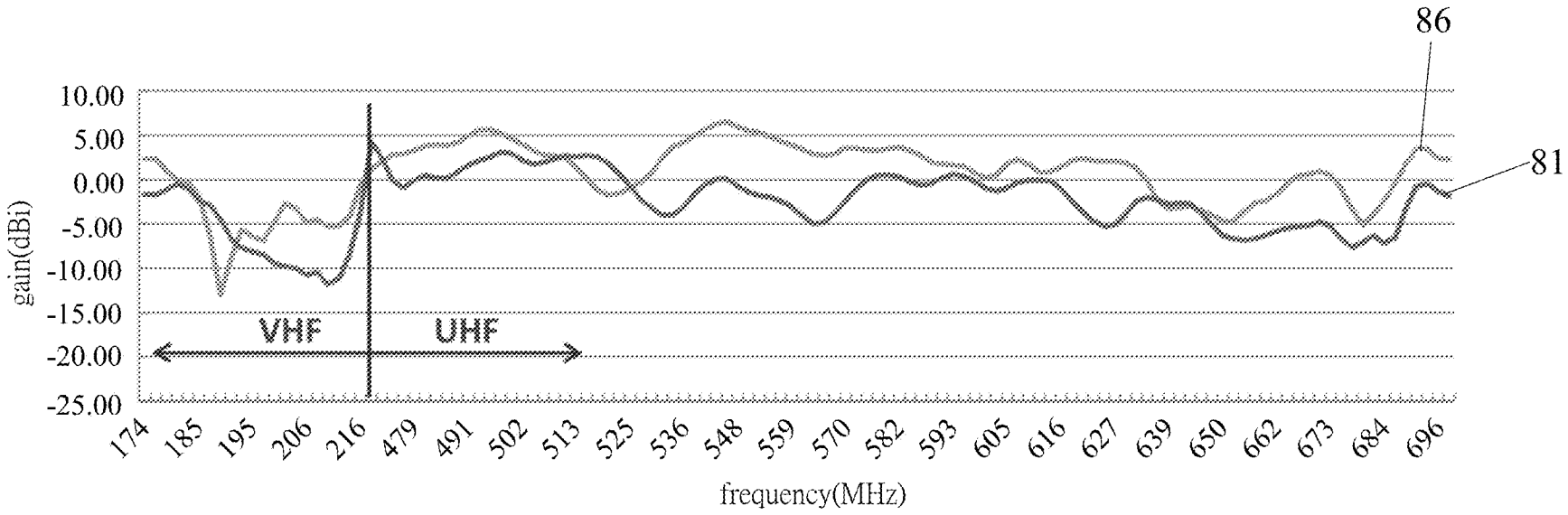
FIGS. 9 to 12 are plots illustrating gain versus frequency characteristic for the conventional antenna device, the second embodiment and a modification of the second embodiment.
Figure 10:
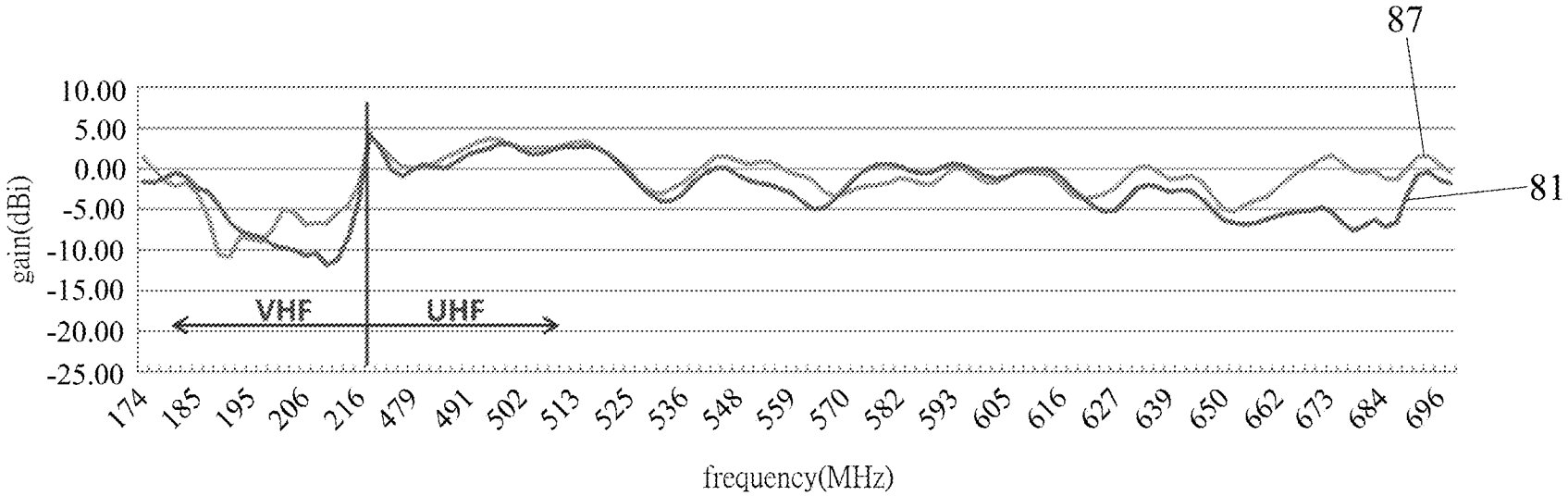
Figure 11:
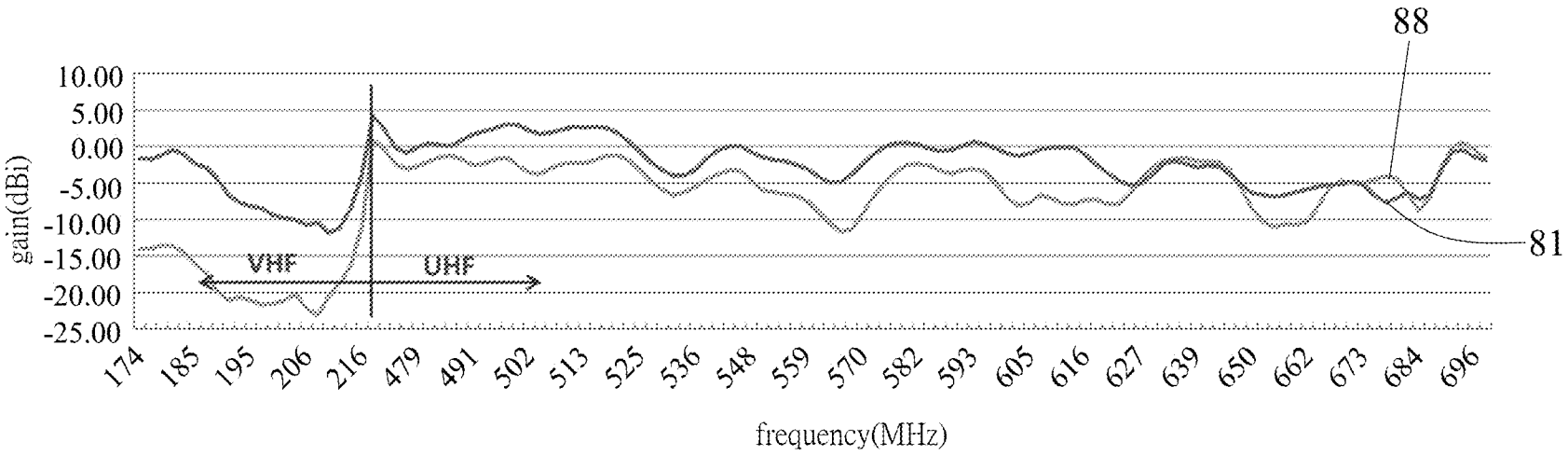
Figure 12:
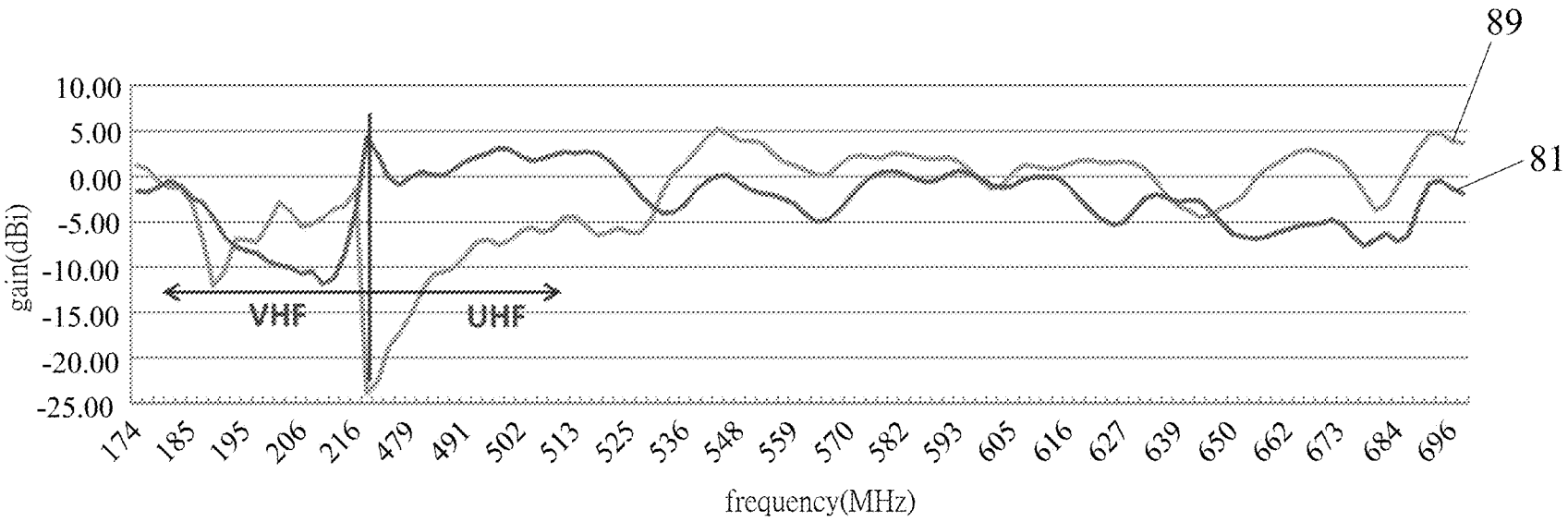

Referring to FIG. 8, a second embodiment of the antenna kit according to the disclosure is a modification of the first embodiment, and differs from the first embodiment in that: (a) for each of the main radiating modules 21, the end part of the first edge 221 adjacent to the main feed point 211 is straight, instead of being stair-shaped; and (b) for each of the auxiliary radiating units 32, the end part of the first edge 321 adjacent to the respective one of the auxiliary feed points 31 is straight, instead of being stair-shaped.

Example values for various dimensions of the antenna kit of the second embodiment are given in FIG. 8. Although a distance between the main and auxiliary antenna units 2, 3 is shown to be 62.6 mm in FIG. 8, it is suitably in a range from 2 mm to 62.6 mm. Each of the other dimensions is suitably in a range from 60% to 140% of the corresponding example value shown in FIG. 8, and is more suitably in a range from 70% to 130% of the corresponding example value shown in FIG. 8.

FIGS. 9 to 12 depict five curves 81, 86-89 that respectively illustrate gain performances of the conventional antenna device (see FIG. 1), the combination of the main and auxiliary antenna units 2, 3 (see FIG. 8) of this embodiment, the main antenna unit 2, the auxiliary antenna unit 3 and a combination of main and auxiliary antenna units of a modified embodiment in the VHF and UHF bands. In the modified embodiment, the inductive element 41 (see FIG. 3) of each of the connecting units 4 (see FIG. 8) is omitted.

Table 2 illustrates average gains of the conventional antenna device (see FIG. 1), the combination of the main and auxiliary antenna units 2, 3 (see FIG. 8) of this embodiment, the main antenna unit 2, the auxiliary antenna unit 3, and the combination of the main and auxiliary antenna units of the modified embodiment in the VHF band, the UHF band and a combination of the VHF and UHF bands.

TABLE 2

| | I | II | III | IV | V |
|---|---|---|---|---|---|
| average gain in VHF band | −6.31 dBi | −3.77 dBi | −5.26 dBi | −18.21 dBi | −4.27 dBi |
| average gain in UHF band | −1.76 dBi | 1.57 dBi | −0.38 dBi | −4.70 dBi | −1.77 dBi |
| average gain in combination of VHF and UHF bands | −8.08 dBi | −2.20 dBi | −5.64 dBi | −22.91 dBi | −6.04 dBi |

I: conventional antenna device
II: combination of main and auxiliary antenna units of this embodiment
III: main antenna unit
IV: auxiliary antenna unit
V: combination of main and auxiliary antenna units of modified embodiment It can be reasonably determined from FIGS. 9 to 12 and Table 1 that: (a) the average gains of the combination of the main and auxiliary antenna units 2, 3 of this embodiment in the VHF band, the UHF band and the combination of the VHF and UHF bands are respectively better than those of the conventional antenna device; (b) the average gains of the main antenna unit 2 in the VHF band, the UHF band and the combination of the VHF and UHF bands are respectively better than those of the conventional antenna device; and (c) the average gains of the combination of the main and auxiliary antenna units of the modified embodiment in the VHF band and the combination of the VHF and UHF bands are respectively better than those of the conventional antenna device.

Referring back to FIG. 8, in view of the above, the antenna kit of the second embodiment is flexible in use as is the first embodiment. In addition, both utilizing the combination of the main and auxiliary antenna units 2, 3 and utilizing solely the main antenna unit 2 deliver good gain performance in the UHF band used in digital television broadcasting. Moreover, as compared to the first embodiment, the antenna kit of the second embodiment is easy to layout and has good manufacturing yield rate.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that the disclosure is not limited to the disclosed embodiments but is intended to cover various arrangements included within the spirit and scope of the broadest interpretation so as to encompass all such modifications and equivalent arrangements.

What is claimed is:

1. An antenna kit comprising:

a main antenna unit to be disposed on a first dielectric substrate, and including two main radiating modules substantially symmetrical with respect to a first axis, each of said main radiating modules including a main feed point that is adjacent to the first axis, a main radiating portion that extends and expands from said main feed point and away from the first axis, and an extending portion that extends toward the first axis from a first vertex part of said main radiating portion distal from the first axis and that does not reach the first axis;

an auxiliary antenna unit to be disposed on a second dielectric substrate, and substantially symmetrical with respect to a second axis, said auxiliary antenna unit including two auxiliary feed points respectively disposed at two sides of the second axis and adjacent to the second axis, two auxiliary radiating portions each extending and expanding from a respective one of said auxiliary feed points and away from the second axis, and a connecting portion connected to respective first vertex parts of said auxiliary radiating portions distal from the second axis; and two connecting units, each of which is connected to a second vertex part of said main radiating portion of a respective one of said main radiating modules that is distal from said main feed point and said extending portion of said respective one of said main radiating modules, and each of which is connected further to a second vertex part of a respective one of said auxiliary radiating portions that is distal from said auxiliary feed points and said connecting portion, each of said connecting units being capable of being assembled such that said main radiating portion of said respective one of said main radiating modules and said respective one of said auxiliary radiating portions are connected to each other via said assembled connecting unit.

2. The antenna kit of claim 1, wherein for each of said main radiating modules, said main radiating portion has: a first edge extending from a location adjacent to said main feed point, away from the first axis and along a direction diagonal to the first axis; a second edge extending from the location adjacent to said main feed point, away from the first axis and along a direction perpendicular to the first axis; and a third edge extends from an end point of said first edge distal from the first axis, to an end point of said second edge distal from the first axis, and along a direction parallel to the first axis.

3. The antenna kit of claim 2, wherein for each of said main radiating modules, said extending portion extends from an end part of said first edge of said main radiating portion adjacent to said third edge of said main radiating portion.

4. The antenna kit of claim 3, wherein for each of said main radiating modules, said extending portion extends along a direction perpendicular to the first axis.

5. The antenna kit of claim 2, wherein for each of said main radiating modules, an end part of said first edge of said main radiating portion adjacent to said main feed point is stair-shaped.

6. The antenna kit of claim 1, wherein each of said auxiliary radiating portions has: a first edge extending from a location adjacent to said respective one of said auxiliary feed points, away from the second axis and along a direction diagonal to the second axis; a second edge extending from the location adjacent to said respective one of said auxiliary feed points, away from the second axis and along a direction perpendicular to the second axis; and a third edge extending from an end point of said first edge distal from the second axis, to an end point of said second edge distal from the second axis, and along a direction parallel to the second axis.

7. The antenna kit of claim 6, wherein said connecting portion is connected to respective end parts of said first edges of said auxiliary radiating portions respectively adjacent to said third edges of said auxiliary radiating portions.

8. The antenna kit of claim 7, wherein said connecting portion extends along a direction perpendicular to the second axis.

9. The antenna kit of claim 6, wherein for each of said auxiliary radiating portions, an end part of said first edge adjacent to said respective one of said auxiliary feed points is stair-shaped.

10. The antenna kit of claim 1, wherein each of said connecting units includes: an inductive element connected to said second vertex part of said main radiating portion of said respective one of said main radiating modules; and a conductive element connected to said inductive element and said second vertex part of said respective one of said auxiliary radiating portions, and capable of being assembled such that said main radiating portion of said respective one of said main radiating modules and said respective one of said auxiliary radiating portions are connected to each other via said inductive element and said assembled conductive element.

* * * * *